US012050087B2

(12) United States Patent
Salisbury et al.

(10) Patent No.: US 12,050,087 B2
(45) Date of Patent: Jul. 30, 2024

(54) ELECTRODE WAD FOR A CONDUCTED ELECTRICAL WEAPON

(71) Applicant: Axon Enterprise, Inc., Scottsdale, AZ (US)

(72) Inventors: Luke Salisbury, Scottsdale, AZ (US); Albert Lavin, Seattle, WA (US); Aleksander Petrovic, Phoenix, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 18/186,625

(22) Filed: Mar. 20, 2023

(65) Prior Publication Data

US 2024/0077286 A1 Mar. 7, 2024

Related U.S. Application Data

(63) Continuation of application No. 17/382,006, filed on Jul. 21, 2021, now Pat. No. 11,609,070, which is a continuation of application No. 16/747,961, filed on Jan. 21, 2020, now Pat. No. 11,098,986, which is a continuation of application No. 16/362,243, filed on Mar. 22, 2019, now abandoned, which is a continuation of application No. 16/193,169, filed on Nov. 16, 2018, now Pat. No. 10,281,246, which is a continuation of application No. 15/909,497, filed on Mar. 1, 2018, now Pat. No. 10,168,127.

(60) Provisional application No. 62/621,876, filed on Jan. 25, 2018.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
USPC ..... 42/1.08; 361/232
See application file for complete search history.

(56) References Cited

U.S. PATENT DOCUMENTS

| | | | |
|---|---|---|---|
| 3,803,463 | A | 4/1974 | Cover |
| 4,253,132 | A | 2/1981 | Cover |
| 5,831,199 | A | 11/1998 | McNulty, Jr. et al. |
| 7,234,262 | B2 | 6/2007 | Smith |
| 7,327,549 | B2 | 2/2008 | Smith et al. |
| 7,444,940 | B2 | 11/2008 | Kapeles et al. |
| 7,950,329 | B1 | 5/2011 | Nemtyshkin et al. |

(Continued)

FOREIGN PATENT DOCUMENTS

| | | | |
|---|---|---|---|
| CN | 1818532 | A | 8/2006 |
| CN | 104613811 | A | 5/2015 |

(Continued)

OTHER PUBLICATIONS

Israel Patent Office, Office Action for Israel Application No. 276268 mailed Oct. 23, 2023.

(Continued)

*Primary Examiner* — Reginald S Tillman, Jr.
(74) *Attorney, Agent, or Firm* — Justin Powley

(57) ABSTRACT

A conducted electrical weapon ("CEW") impedes locomotion of a human or animal target by providing a stimulus signal through one or more electrodes and through the target. The CEW includes a handle and one or more removable deployment units coupled to the handle. A deployment unit may include a wad, a tensioner, a guide, and posts to improve accuracy of launch of electrodes form the deployment unit.

20 Claims, 8 Drawing Sheets

(56) References Cited

U.S. PATENT DOCUMENTS

| | | | |
|---|---|---|---|
| 7,984,676 | B1 | 7/2011 | Gavin et al. |
| 8,074,573 | B1 | 12/2011 | Linker |
| 8,339,763 | B2 | 12/2012 | McNulty, Jr. |
| 10,168,127 | B1 | 1/2019 | Salisbury et al. |
| 10,809,040 | B2 | 10/2020 | Kim |
| 2005/0262994 | A1 | 12/2005 | McNulty |
| 2006/0207466 | A1 | 9/2006 | McNulty, Jr. |
| 2006/0254108 | A1 | 11/2006 | Park |
| 2006/0279898 | A1 | 12/2006 | Smith et al. |
| 2007/0019357 | A1 | 1/2007 | Keely |
| 2012/0019975 | A1 | 1/2012 | Hanchett et al. |
| 2012/0170167 | A1 | 7/2012 | Beechey et al. |
| 2014/0233146 | A1 | 8/2014 | Gavin |
| 2014/0293499 | A1 | 10/2014 | Beechey et al. |
| 2015/0002981 | A1 | 1/2015 | Klug et al. |
| 2015/0153144 | A1 | 6/2015 | Cheatham, III et al. |
| 2016/0010956 | A1 | 1/2016 | Hanchett |
| 2016/0010957 | A1 | 1/2016 | Beechey et al. |
| 2016/0279433 | A1 | 9/2016 | Cheatham, III et al. |
| 2017/0304639 | A1 | 10/2017 | Cheatham, III et al. |

FOREIGN PATENT DOCUMENTS

| | | | |
|---|---|---|---|
| CN | 205425968 | U | 8/2016 |
| CN | 106767174 | B | 5/2017 |
| WO | 2018194701 | A1 | 10/2018 |

OTHER PUBLICATIONS

Canadian Intellectual Property Office, Office Action for Canadian Application No. 3,089,303 mailed Feb. 15, 2024.
USPTO, Notice of Allowance and Fee(s) Due for U.S. Appl. No. 15,909,497 mailed Sep. 13, 2018.
USPTO, Notice of Allowance and Fee(s) Due for U.S. Appl. No. 16/193,169 mailed Jan. 9, 2019.
USPTO, Non-Final Office Action for U.S. Appl. No. 16/362,243 mailed May 23, 2019.
USPTO, Notice of Allowance and Fee(s) Due for U.S. Appl. No. 16/362,243 mailed Oct. 18, 2019.
USPTO, Non-Final Office Action for U.S. Appl. No. 16/747,961 mailed Aug. 26, 2020.
USPTO, Final Office Action for U.S. Appl. No. 16/747,961 mailed Feb. 22, 2021.
USPTO, Notice of Allowance and Fee(s) Due for U.S. Appl. No. 16/747,961 mailed Apr. 21, 2021.
International Searching Authority, International Search Report and Written Opinion for International Application No. PCT/US2018/020466 mailed Oct. 25, 2018.
IP Australia, Examination Report No. 1 for Application No. 2018405217 dated May 26, 2021.
KIPO, Notice of Grounds for Rejection for Korean Patent Application No. 10-2020-7024394 issued Jun. 28, 2021.
IPOS, Search Report and Written Opinion for Patent Application No. 11202006891S dated Jul. 5, 2021.
Taiwan Intellectual Property Office, Taiwan Office Action and Search Report for Taiwan Patent Application No. 107108594 dated Feb. 18, 2019.
Taiwan Intellectual Property Office, Taiwan Allowance Decision of Examination for Taiwan Patent Application No. 107108594 dated Jun. 25, 2019.
Taiwan Intellectual Property Office, Taiwan Office Action and Search Report for Taiwan Patent Application No. 108124935 dated Jan. 8, 2020.
Taiwan Intellectual Property Office, Taiwan Allowance Decision of Examination for Taiwan Patent Application No. 108124935 dated Feb. 19, 2020.
Taiwan Intellectual Property Office, Taiwan Office Action and Search Report for Taiwan Patent Application No. 109107725 dated Sep. 8, 2020.
Taiwan Intellectual Property Office, Taiwan Allowance Decision of Examination for Taiwan Patent Application No. 109107725 dated Feb. 17, 2021.
New Zealand Intellectual Property Office, Patent Examination Report 1 for New Zealand Application No. 767236 mailed Aug. 18, 2021.
European Patent Office, Extended European Search Report for European Patent Application No. 18902547.1 mailed Sep. 24, 2021.
Intellectual Property Office of Singapore, Notice of Eligibility for Grant for Singapore Application No. 11202006891S mailed Apr. 20, 2022.
Korean Intellectual Property Office, Decision For Grant of Patent for Korean Application No. 10-2022-7007530 mailed Jun. 7, 2022.
Brazillian Patent Office, Search Report for Brazil Application No. 11 2020 015172 6 mailed Jul. 4, 2022.
European Patent Office, Communication under Rule 71(3) EPC for European Application No. 18902547.1-1015 mailed Sep. 30, 2022.
New Zealand Intellectual Property Office, Patent Examination Report 2 for New Zealand Application No. 767236 mailed Feb. 22, 2022.
Korean Intellectual Property Office, Decision for Grant of Patent for Korean Application No. 10-2020-7024393 mailed Dec. 6, 2021.
European Patent Office, Extended European Search Report for European Application No. 23190917.7 mailed Nov. 7, 2023.
European Patent Office, Extended European Search Report for European Application No. 23155665.5 mailed Jun. 7, 2023.
Brazil Patent Office, Office Action for Brazil Application No. 1120200151726 mailed Apr. 6, 2023.
Brazilian Patent Office, Technical Examination Report for Brazilian Application No. 11 2020 015172 6 mailed Sep. 12, 2023.
IP Australia, Examination Report No. 1 for Australian Application No. 2022200914 mailed Sep. 5, 2023.

ELECTRODE WAD FOR A CONDUCTED ELECTRICAL WEAPON

FIELD OF INVENTION

Embodiments of the present disclosure relate to conducted electrical weapons.

BRIEF DESCRIPTION OF THE SEVERAL VIEWS OF THE DRAWING

Embodiments of the present disclosure will be described with reference to the drawing, wherein like designations denote like elements, and.

DETAILED DESCRIPTION OF INVENTION

Figure 1:
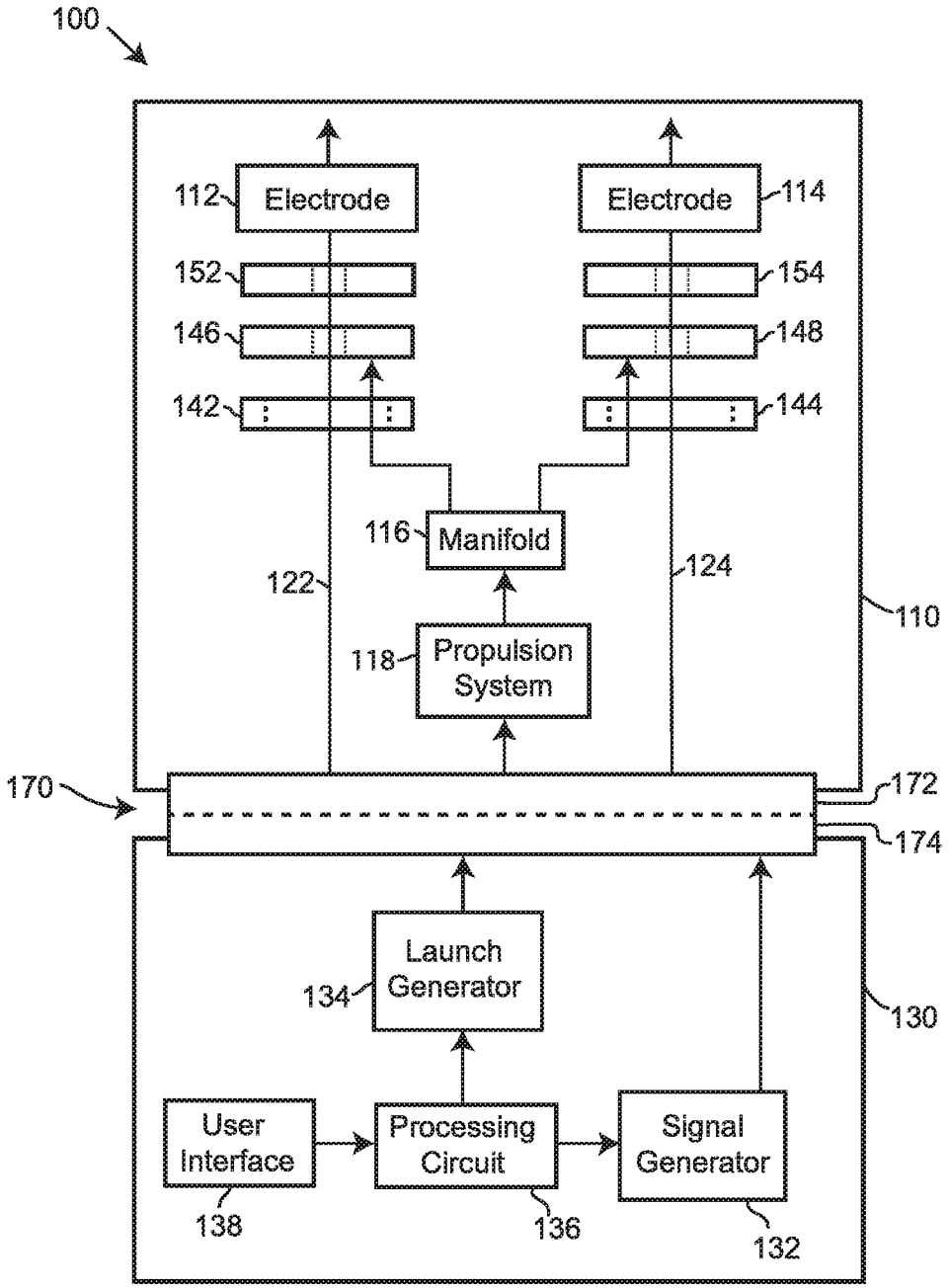
FIG. 1 is a block diagram of a conducted electrical weapon ("CEW") according to various aspects of the present disclosure.

A conducted electrical weapon ("CEW") is a device that provides a stimulus signal to a human or animal target to impede locomotion of the target. A CEW may include a handle and one or more removable deployment units (e.g., cartridges). A removable deployment unit inserts into a bay of the handle. An interface may electrically couple the removable deployment unit to circuitry positioned in the handle. A deployment unit may include one or more wire-tethered electrodes (e.g., darts) that are launched by a propellant toward a target to provide the stimulus signal through the target. A stimulus signal impedes the locomotion of the target. Locomotion may be inhibited by interfering with voluntary use of skeletal muscles and/or causing pain in the target. A stimulus signal that interferes with skeletal muscles may cause the skeletal muscles to lockup (e.g., freeze, tighten, stiffen) so that the target may not voluntarily move.

A stimulus signal may include a plurality of pulses of current (e.g., current pulses). Each pulse of current delivers a current (e.g., amount of charge) at a voltage. A voltage of at least a portion of a pulse may be of a magnitude (e.g., 50,000 volts) to ionize air in a gap to establish a circuit to deliver the current to a target. A gap of air may exist between an electrode (e.g., dart) and tissue of the target. Ionization of air in the gap establishes an ionization path of low impedance for delivery of the current to the target.

The stimulus signal is generated by a signal generator. The signal generator may be controlled by a processing circuit, which may also control a launch generator. The processing circuit may receive input from a user interface, and possibly information from other sources. The user interface may be as simple as a safety switch (e.g., on/off) and a trigger that is pulled to operate the weapon. An example of information from other sources may be a signal that indicates that a deployment unit is loaded into a bay in the handle and is ready for use.

The processing circuit may send commands to the launch generator to launch one or more wire-tethered electrodes and/or engage the signal generator based on input received from the user interface or other possible sources. Upon receiving a launch command from the processing circuit, the launch generator controls the propulsion system to provide a force to launch one or more electrodes.

A force for launching one or more electrodes from a bore or bores in a deployment unit may include release of a rapidly expanding gas. The force from the gas propels the one or more electrodes from the one or more bores toward the target. The rapidly expanding gas enters a rear (e.g., rear-end portion) of a bore to provide a force on an electrode to push (e.g., propel, launch) the electrode from the bore. An electrode exits the front (e.g., front-end portion) of a bore to fly toward a target. A bore includes a central axis. At launch, an electrode initially flies a trajectory (e.g., path, line) that is along the central axis.

A wad may be positioned at the rear-end portion of an electrode while it is positioned in a bore. The wad makes contact with an inner wall of the bore to seal the bore. The expanding gas enters to bore from behind (e.g., with respect to the direction of launch) the wad. The seal between the wad and the inner wall of the bore reduces (e.g., decreases, inhibits) leaks of the expanding gas around from behind the wad and around the electrode thereby maximizing the force delivered by the expanding gas on the electrode.

A force from a rapidly expanding gas directed provided to (e.g., steered toward) a deployment unit may apply a force on the deployment unit so that the housing of the deployment unit moves in the handle. Further, applying the force of the rapidly expanding gas on an electrode in a bore causes an equal and opposite force (e.g., recoil) on the deployment unit that may further move the deployment unit in the bay of the handle. Movement of a deployment unit in a handle bay at the time of launch may cause loss of accuracy in the launch trajectory of the electrodes and/or the flight path of the electrodes.

Posts extending outward from the sides of a deployment unit may slide into slots in a bay of a handle to fortify (e.g., solidify, secure, stabilize) the mechanical coupling of the removable deployment unit in the bay of the handle. Securing the deployment unit in the bay of the handle impedes (e.g., hinders, diminishes, reduces) movement of the deployment unit during launch thereby improving accuracy.

In a CEW that holds multiple deployment units, posts may be positioned on the respective deployment units in a configuration whereby a portion of the posts of two or more deployment units link (e.g., mechanically couple, join, lock, interlock) together to further increase the stability of the deployment units during launch. Deployment units that are linked together may be referred to herein as linked deployment units. For example, two deployment units may be linked together to increase stability during launch. In the case of two deployment, deployment units that are linked together may be referred to as a deployment pair. A deployment pair that may be removed (e.g., unloaded) from and inserted (e.g., loaded) into a CEW handle together as a set. Loading and unloading a deployment pair may facilitate faster reloading of a CEW. Further, the improved stability provided by the deployment pair may improve accuracy.

In an implementation, a post has the shape of an I-beam in which the width of the top and bottom of the post is wider than the portion of the post that connects the top and the bottom.

As an electrode flies toward a target, the electrode deploys (e.g., extends) a filament (e.g., wire). The filament may be wound in a winding (e.g., coils). The winding may be positioned (e.g., stored) in the electrode. The winding of the filament may unravel (e.g., uncoil) to deploy the filament. The filament deploys from the winding through an opening in the back of the electrode. A tensioner may be positioned at the rear of the electrode. A tensioner may be coupled to the rear of the electrode. The tensioner may have a hole (e.g., bore, opening) therethrough that is axially centered with the opening in the back of the electrode. The diameter of the hole may be about the same as or slightly larger than the diameter of the filament.

As the filament deploys from the electrode, the filament moves through the hole in the tensioner. Friction between an inner wall of the hole of the tensioner and the filament applies a force on the filament. In an implementation where the tensioner is coupled to the electrode, applying a force on the filament by the tensioner during deployment provides drag on the electrode. Providing drag on the electrode increases stability of flight of the electrode and accuracy of flight along an intended trajectory. Increasing stability and/or accuracy improves the repeatability of flight along intended trajectory of electrodes launched from different deployment units.

As a filament deploys from the winding in the electrode, one end portion of the filament remains coupled to the deployment unit. The position where the filament couples to the deployment unit may position the extended filament in-line (e.g., along) an initial trajectory of the electrode. Positioning the filament that extends from the deployment unit in-line with an initial trajectory of flight improves the likelihood that the electrode will fly along the trajectory. As discussed above, an initial trajectory of an electrode exiting a bore is along a central axis of the bore. A guide may be positioned inside a bore to hold (e.g., keep, retain) the filament in alignment (e.g., long) or close (e.g., proximate) to the central axis of the bore. A guide may align a filament along or close to a central axis of a bore at least during launch of an electrode form the bore and for a period of time thereafter. A guide may be positioned inside at a rear-end portion of a bore.

An end portion of the filament remains coupled to the deployment unit before, during and after launch of the electrode. The filament remains coupled through an interface to a signal generator in the handle to deliver the current to the target. The deployment unit establishes an electrical coupling with the interface upon insertion of the deployment unit into a bay of the handle. The deployment unit electrically decouples from the interface upon removal of the deployment unit from the bay of the handle. A guide may contact the end portion of the filament that remains coupled to the deployment unit. A guide may position a filament at the location (e.g., point) of contact at or close to the central axis of a bore. From the point of contact with the guide, a filament that has been deployed from an electrode during launch, at least during an initial portion of launch, may extend from a bore. An initial portion of launch includes the exit of an electrode from a bore and for a period of time (e.g., several feet of travel) thereafter. During the initial portion of launch, the deployed filament may extend along or proximate to the central axis of the bore.

The other end portion of the filament remains coupled to the electrode, or at least to a portion thereof (e.g., front, spear), before, during, and after launch to deliver the current from the signal generator to the target via the filament. An electrode may include a spear. A spear may couple to target clothing or embed in target tissue to retain the electrode coupled to the target.

A propulsion system provides a force for launching one or more wire-tethered electrodes from a deployment unit. A propulsion system provides the force to propel the one or more electrodes toward a target. A propulsion system may release a rapidly expanding gas to propel the one or more electrodes. A propulsion system may be in fluid communication with an opening in a rear-end portion of one or more bores. A rapidly expanding gas may flow from a propulsion system and enter the opening at the rear-end portion of one or more bores to launch the respective projectiles positioned in the one or more bores.

A propulsion system may receive a signal for launching (e.g., releasing the rapidly expanding gas) responsive to operation of a control (e.g., switch, trigger) of a user interface of the CEW. A propulsion system may include a pyrotechnic that ignites (e.g., burns) to release a compressed gas from a canister to launch the electrodes. A canister (e.g., capsule) holds (e.g., retains) a compressed gas (e.g., air, nitrogen, inert). When the canister is opened (e.g., pierced), the compressed gas from the canister rapidly expands to provide a force to launch the electrodes.

A manifold may transport (e.g., delivery, carry, direct) the rapidly expanding gas from the compressed gas to one or more electrodes to launch the electrodes from the deployment unit. A manifold may include structures (e.g., channels, guides, passages) for transporting a rapidly expanding gas from a source (e.g., burning pyrotechnic, canister of compress gas) of the rapidly expanding gas to the electrodes. A manifold may transport a rapidly expanding gas from the source to one or more bores that hold the one or more electrodes respectively.

For example, CEW 100 of FIG. 1 performs the functions of a CEW and includes the structures as discussed above. CEW 100 includes deployment unit 110, interface 170, and handle 130. Deployment unit 110 and handle 130 perform the function of a deployment unit and a handle respectively.

Deployment unit 110 includes propulsion system 118, manifold 116, electrode 112, electrode 114, guide 142, guide 144, wad 146, wad 148, tensioner 152, tensioner 154, filament 122, filament 124, and interface portion 172. Propulsion system 118 and manifold 116 perform the functions of a propulsion system and a manifold respectively as discussed above. Electrodes 112 and electrode 114 perform the functions of an electrode as discussed above. Filament 122, guide 142, wad 146, and tensioner 152 cooperate with electrode 112. Filament 124, guide 144, wad 148, and tensioner 154 cooperate with electrode 114.

Handle 130 includes launch generator 134, processing circuit 136, signal generator 132, user interface 138, and interface portion 174. Launch generator 134 and processing circuit 136 perform the functions of a launch generator and a processing circuit respectively as discussed above. Signal generator 132 and user interface 138 respectively perform the functions of a signal generator and a user interface as discussed above.

Although only one deployment unit 110 is shown in FIG. 1, as discussed above, CEW 100 may cooperate with one or more deployment units 110 at the same time. One or more deployment units 110 may couple to (e.g., be inserted into) handle 130 at the same time. A deployment unit may couple to (e.g., attach to, plug into, insert into) a handle. A deployment unit may be decoupled (e.g., detached) and separated (e.g., be removed) from the handle. A deployment unit may be decoupled from a handle after a use (e.g., launch electrodes, deliver current) of the deployment unit. A used deployment unit may be replaced with an unused deployment unit and coupled to the handle. Coupling a deployment unit to a handle mechanically and electrically couples the deployment unit to the handle.

Coupling a deployment unit to a handle enables the deployment unit to communicate (e.g., send, receive) with the handle. Communication includes providing and/or receiving control signals (e.g., launch signal), stimulus signals, information, and/or power. Interface 170 enables communication between handle 130 and deployment unit 110 as discussed above. Interface 170 includes interface portion 172 that is part of deployment unit 110 and interface portion 174 that is part of handle 130. Interface portion 172 is part of deployment unit 110 and remains with deployment unit 110. Each deployment unit 110 includes its own interface portion 172 respectively. Interface portion 172 is part of handle 130 and remains with handle 130. Handle 130 may include one or more bays for respectively receiving one or more deployment units 110. A bay may include one or more interface portions 174 to interface with the one or more deployment units 110 inserted into the bay.

An interface portion may include any electrical, sonic, and/or optical component for receiving and/or providing information, signals, and/or power. For example, interface portions 172 and 174 may include one or more contacts (e.g., electrical contacts). While deployment unit 110 is inserted into a bay of handle 130, the one or more contacts of interface portion 172 may physically contact (e.g., touch) the one or more contacts of interface portion 174 thereby establishing interface 170 by which deployment unit 110 may communicate (e.g., send, receive) information, signals, and/or power with handle 130. In another example, interface portion 172 and 174 may respectively include one or more light sources (e.g., LEDs, lasers) and one or more photo sensors (e.g., light detectors, photoelectric sensor). Insertion of deployment unit 110 into a bay permits the one or more light sources of interface portion 172 to provide light to photo sensors of interface portion 174 and vice versa. The light sources and photo sensors may be used to communicate information between deployment unit 110 and handle 130.

While deployment unit 110 is inserted into a bay of handle 130, interface portion 172 for that deployment unit cooperates with (e.g., aligns with, electrically couples to, mates with) interface portion 174 for that bay to form interface 170. Removing deployment unit 110 from the bay physically separates (e.g., decouples) interface portion 172 for that deployment unit from interface portion 174 for that bay thereby terminating interface 170.

Handle 130 may provide signals from signal generator 132 and/or launch generator 134 to deployment unit 110 via interface 170. A launch signal from launch generator 134 may cooperate with (e.g., instruct, initiate, control, operate) propulsion system 118 to launch electrodes 112 and 114 from deployment unit 110. A stimulus signal from signal generator 132 may be delivered (e.g., transported, carried) by electrodes 112 and 114 and their respective filaments 122 and 124 to a human or animal target to interfere with locomotion of the target.

Handle 130 may have a form-factor for ergonomic use by a human user. A user may hold (e.g., grasp) handle 130. A user may manually operate user interface 138 to operate (e.g., control, initiate operation of, halt operation of) CEW 100. A user may aim (e.g., point) CEW 100 to direct the deployment of electrodes 112 and 114 toward a specific target.

A processing circuit includes any circuitry and/or electrical/electronic subsystem for performing a function. A processing circuit may include circuitry that performs (e.g., executes) a stored program. A processing circuit may include a digital signal processor, a microcontroller, a microprocessor, an application specific integrated circuit, a programmable logic device, logic circuitry, state machines, MEMS devices, signal conditioning circuitry, communication circuitry, a computer, a radio, a network appliance, data busses, address busses, and/or a combination thereof in any quantity suitable for performing a function and/or executing one or more stored programs.

A processing circuit may further include passive electronic devices (e.g., resistors, capacitors, inductors) and/or active electronic devices (e.g., op amps, comparators, analog-to-digital converters, digital-to-analog converters, programmable logic). A processing circuit may include data buses, output ports, input ports, timers, memory, and arithmetic units.

A processing circuit may provide and/or receive electrical signals whether digital and/or analog in form. A processing circuit may provide and/or receive digital information via a bus using any protocol. A processing circuit may receive information, manipulate the received information, and provide the manipulated information. A processing circuit may store information and retrieve stored information. Information received, stored, and/or manipulated by the processing circuit may be used to perform a function and/or to perform a stored program.

A processing circuit may control the operation and/or function of other circuits and/or components of a system. A processing circuit may receive data from other circuits and/or components of a system. A processing circuit may receive status information and/or information regarding the operation of other components of a system. A processing circuit may perform one or more operations, perform one or more calculations, provide commands (e.g., instructions, signals) to one or more other components responsive to data and/or status information. A command provided to a component may instruct the component to start operation, continue operation, alter operation, suspend operation, and/or cease operation. Commands and/or status may be communicated between a processing circuit and other circuits and/or components via any type of buss including any type of data/address bus.

A processing circuit may include memory for storing data and/or programs for execution.

A launch generator provides a signal (e.g., launch signal) to a deployment unit. A launch generator may provide a launch signal to one or more propulsion systems of one or more deployment unit respectively. A launch signal may initiate (e.g., start, begin) operation of a propulsion system to launch one or more electrodes. A launch signal may ignite a pyrotechnic. A launch signal may be provided from a launch generator to a deployment unit via an interface. A launch generator may be controlled by and/or cooperate with a processing circuit to perform the functions of a launch generator. A launch generator may receive power for a power supply (e.g., battery) to perform the functions of a launch generator. A launch signal may include an electrical signal provided at a voltage. A launch generator may include circuits for transforming power from a power supply into a launch signal. A launch generator may include one or more transformers to transform a voltage from a power supply into a signal provided at a higher voltage.

A signal generator provides (e.g., generates, produces) a signal. A signal that accomplishes electrical coupling (e.g., ionization of air in a gap) with a target and/or interferes with locomotion of a target may be referred to as a stimulus signal. A stimulus signal may include a current provided at a voltage. A current may include a pulse of current. A stimulus signal through target tissue may interfere with (e.g., impede) locomotion of the target. A stimulus signal may impede locomotion of a target through inducing fear, pain, and/or an inability to voluntary control skeletal muscles as discussed above.

A stimulus signal may include a one or more (e.g., a series) of pulses of current. Pulses of a stimulus signal may be delivered at a pulse rate (e.g., 22 pps) for a period of time (e.g., 5 second). A signal generator may provide a pulse of current having a voltage in the range of 500 to 100,000 volts. A pulse of current may be provided at one or more magnitudes of voltage. A pulse of current may include a high voltage portion for ionizing gaps of air (e.g., between an electrode and a target) to electrically couple the signal generator to a target. A pulse of current provided at about 50,000 volts may ionize air in one or more gaps of up to one inch in series between a signal generator and a target.

Ionizing of air in the one or more gap between a signal generator and a target establishes low impedance ionization paths for delivering a current from a signal generator to a target. After ionization, the ionization path will persist (e.g., remain in existence) as long as a current is provided via the ionization path. When the current provided by the ionization path ceases or is reduced below a threshold, the ionization path collapses (e.g., ceases to exist) and the signal generator (e.g., wire-tethered electrode) is no longer electrically coupled to target tissue. Ionization of air in one or more gaps establishes electrical connectivity (e.g., electrical coupling) of a signal generator to a target to provide the stimulus signal to the target. A signal generator remains electrically coupled to a target as long as the ionization paths exist (e.g., persist).

A pulse may include a lower voltage portion (e.g., 500 to 10,000 volts) for providing current through target tissue to impede locomotion of the target. A portion of a current used to ionize gaps of air to establish electrical connectivity may also contribute to the current provided through target tissue to impede locomotion of the target.

A pulse of a stimulus signal may include a high voltage portion for ionizing gaps of air to establish electrical coupling and a lower voltage portion for providing current through target tissue to impede locomotion of the target. Each pulse of a stimulus signal may be capable of establishing electrical connectivity (e.g., via ionization) of a signal generator with a target and providing a current to interfere with locomotion of the target.

A signal generator includes circuits for receiving electrical energy (e.g., power supply, battery) and for providing the stimulus signal. Electrical/electronic components in the circuits of a signal generator may include capacitors, resistors, inductors, spark gaps, transformers, silicon controlled rectifiers, and/or analog-to-digital converters. A processing circuit may cooperate with and/or control the circuits of a signal generator to produce a stimulus signal.

A user interface provides an interface between a user and a CEW. A user may control, at least in part, a CEW via the user interface. A user may provide information and/or commands to a CEW via a user interface. A user may receive information and/or responses from a CEW via the user interface. A user interface may include one or more controls (e.g., buttons, switches) that permit a user to interact and/or communicate with a device to control (e.g., influence) the operation (e.g., functions) of the device. A user interface of a CEW may include a trigger. A trigger may initiation an operation (e.g., firing, providing a current) of a CEW.

An electrode is propelled (e.g., launched) from a deployment unit toward a target. An electrode couples to a filament. A signal generator may provide a stimulus signal to a target via an electrode that is electrically coupled to a filament. An electrode may include any aerodynamic structure to improve accuracy of flight toward the target. An electrode may include structures (e.g., spear, barbs) for mechanically coupling the electrode to a target. An electrode in flight may deploy a filament from a cavity within the electrode. The filament extends from the deployment unit inserted into the handle to the electrode at the target. An electrode may be formed in whole or in part of a conductive material for delivery of the current into target tissue. The filament is formed of a conductive material. A filament may be insulated or uninsulated.

Figure 2:
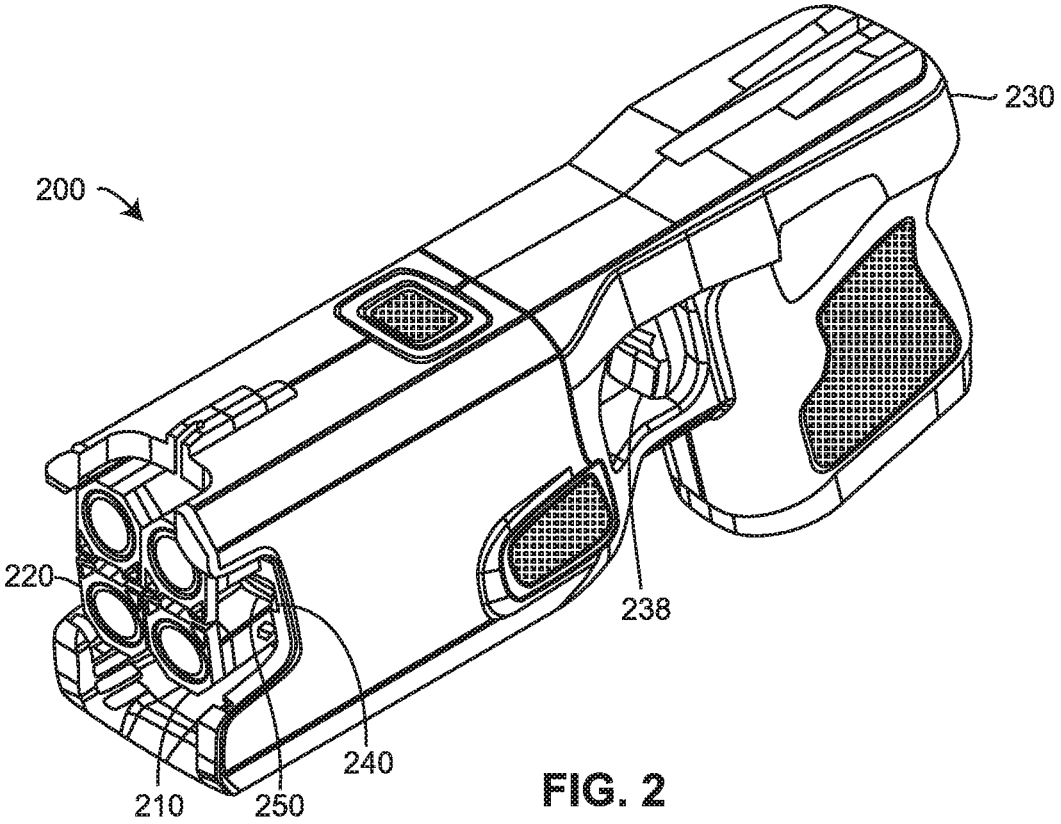
FIG. 2 is a perspective view of an implementation of a CEW.

CEW 200, in FIG. 2, is an implementation of CEW 100. CEW 200 includes handle 230, deployment unit 210, and deployment unit 220. Handle 230 includes slot 240 and slot 1240. Deployment unit 210 includes posts 250, 350, 1050, and 1030. Deployment unit 220 includes posts 1020, 1040, 1060, and 1080. Deployment unit 210 and 220 are inserted into handle 230. Posts 250 and 350 are inserted into slot 240. Posts 1060 and 1080 insert into slot 1240. Posts 1020, 1030, 1040, and 1050 interlock with each other. Handle 230 includes trigger 238. Trigger 238 may be implemented as a component of user interface 138.

Handle 230 performs the functions of a handle discussed above. Deployment unit 210 and/or 220 perform the functions of a deployment unit discussed above. Posts 250, 350, 1020, 1030, 1040, 1050, 1060, and 1080 performs the functions of a post discussed above. Trigger 238 performs the functions of a trigger discussed above.

Figure 3:
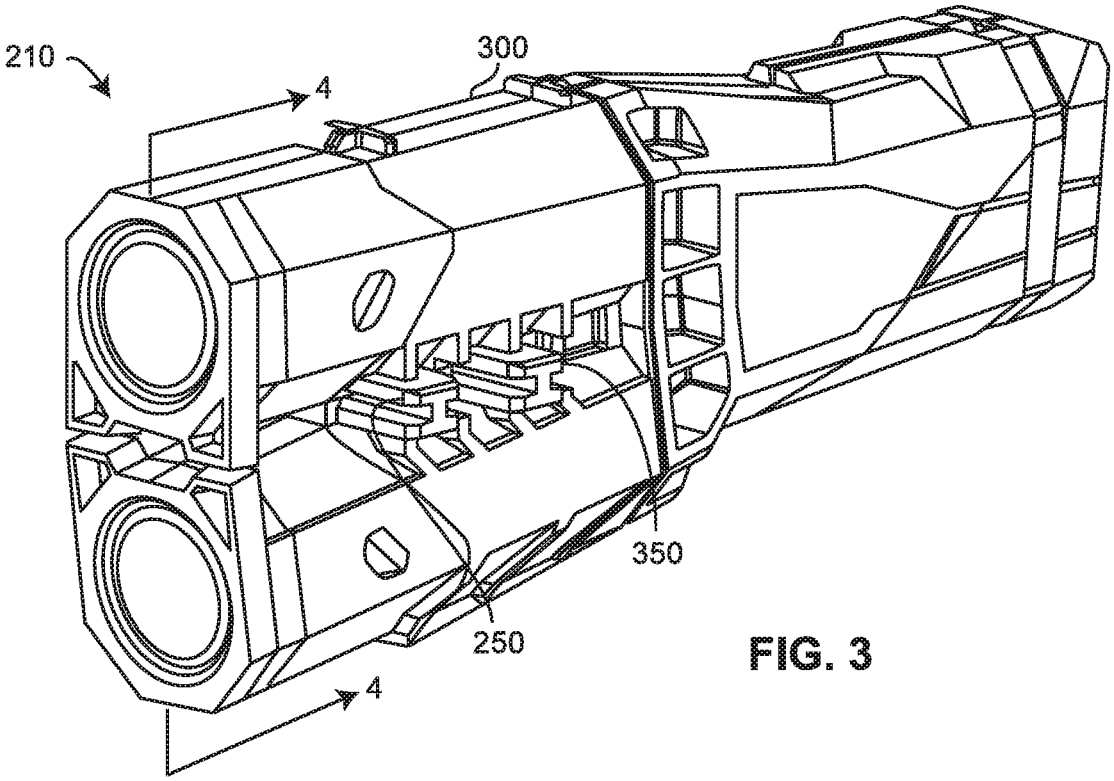
FIG. 3 is a perspective view of an implementation of a deployment unit.
Figure 4:
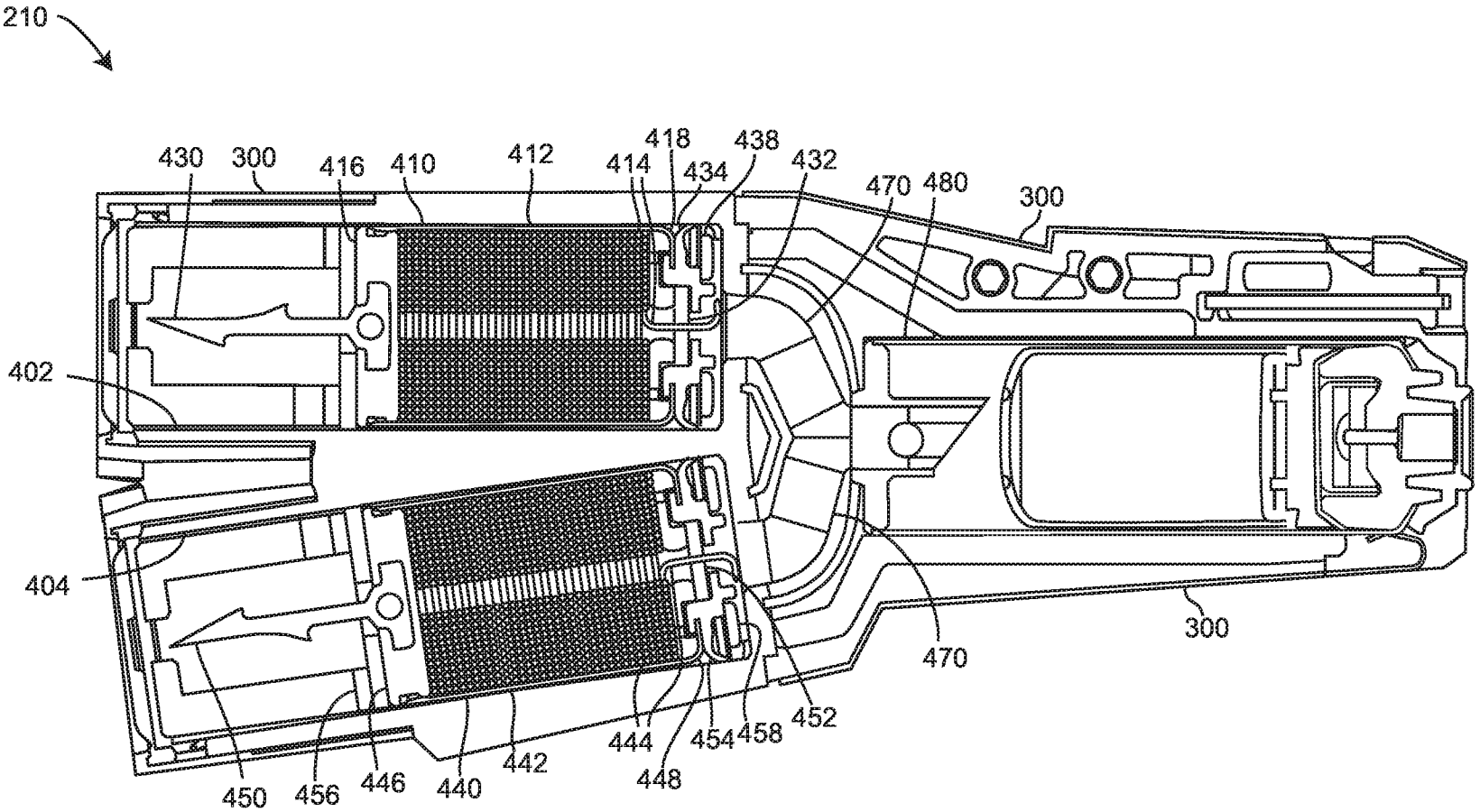
FIG. 4 is a cross-section of the deployment unit of FIG. 3 along axis 4-4.

Deployment unit 210 of FIG. 3 is deployment unit 210 of FIG. 2 decoupled from handle 230. Deployment unit 210 includes housing 300, electrode 410, electrode 440, guide 438, guide 458, manifold 470, and propulsion system 480. Electrode 410 and 440 perform the functions of an electrode discussed above. Guides 438 and 458 perform the function of a guide discussed above. Manifold 470 and propulsion system 480 perform the functions of a manifold discussed and a propulsion system respectively as discussed above.

Housing 300 includes bore 402 and bore 404. Electrode 410 includes body 412, filament 414, front wall 416, rear wall 418, tensioner 432, wad 434, and spear 430. Electrode 440 includes body 442, filament 444, front wall 446, rear wall 448, tensioner, 452, wad 454, and spear 450. Tensioners 432 and 452 perform the function of a tensioner discussed above. Wads 434 and 454 perform the function of a wad discussed above.

Housing 300 includes posts 250 and 350. Posts 250 and 350 are positioned on a side of housing 300 and extend outward. Posts 250 and 350 on deployment unit 210 cooperate with slot 240 in handle 230 to help stabilize deployment unit 210 in handle 230 during launch. Increasing the stability of the mechanical coupling between detachable deployment units 210 and handle 230 may improve CEW accuracy.

Deployment unit 210 cooperates with handle 230 to launch electrodes 410 and 440 toward a target to provide a stimulus signal to the target. Launch generator 134 of handle 230 provides a launch signal via interface 170 to propulsion system 480 positioned within deployment unit 210. Propulsion system 480 provides a force for launching electrodes 410 and 440 in response to receiving a launch signal. Propulsion system 480 provides a force by releasing a rapidly expanding gas. Manifold 470 transports (e.g., delivers, carries, directs) the rapidly expanding gas from propulsion system 480 to bores 402 and 404. The rapidly expanding gas exits manifold 470, enters bore 402, and applies a force on electrode 410 thereby propelling (e.g., launching) electrode 410 from bore 402 toward a target. Similarly, the rapidly expanding gas exits manifold 470, enters bore 404, and applies a force on electrode 440 thereby propelling (e.g., launching) electrode 440 from bore 404 toward the target.

Wad 434 and 454 are positioned rearward of electrodes 410 and 440 respectively. Wad 434 and 454 are coupled to rear wall 418 and 448 respectively. Wad 434 seals bore 402 thereby decreasing (e.g., reducing) the escape (e.g., leaking, bypass) of the rapidly expanding gas between the sides of body 412 and an inner wall of bore 402. Wad 454 seals bore 404 thereby decreasing the escape of the rapidly expanding gas between the sides of body 442 and an inner wall of bore 404. Wad 434 and wad 454 increase the amount of force from the rapidly expanding gas that is delivered to (e.g., acts upon) electrode 410 and electrode 440 respectively. Increasing the amount of force delivered to an electrode increases the muzzle velocity of the electrode. Increasing the muzzle velocity may increase the distance an electrode may fly. Using a wad to seal a bore for delivery of a force against an electrode may improve the consistency (e.g., repeatability) of launch (e.g., muzzle velocity) between different deployment units, which may in turn improve accuracy and repeatability of the launch operation of deployment units.

During launch, electrode 410 exits bore 402 flying toward a target. As electrode 410 travels toward the target, filament 414 stored within body 412 deploys through opening 710 in rear wall 418. Tensioner 432 is positioned at the rear-end portion of electrode 410. In an implementation, tensioner 432 is coupled to wad 434. Tensioner 432 has a hole therethrough. As filament 414 deploys it passes through the hole in tensioner 432. The hole in tensioner 432 may be axially centered with opening 710 in rear wall 418. As filament 414 deploys from electrode 410, filament 414 moves through the hole in tensioner 432. Friction between an inner wall of the hole of tensioner 432 and an outer surface of filament 414 applies a force on filament 414. Applying a force on filament 414 by tensioner 432 provides drag on electrode 410. Providing drag on electrode 410 increases the stability of flight of electrode 410. Providing drag on electrode 410 increases the accuracy of flight along an intended trajectory. Increasing stability and/or accuracy improves the repeatability of flight along intended trajectory of electrodes launched from different deployment units.

Tensioner 452 performs a similar function as tensioner 432 with respect to electrode 440, wad 454, and filament 444 thereby providing the same result of increased drag, stability, accuracy and/or repeatability.

As filament 414 and filament 444 deploy from the winding in electrode 410 and electrode 440 respectively, one end portion of the respective filaments remains coupled to deployment unit 210. Positioning filament 414 and filament 444 so that they extend from bores 402 and 404 respectively in-line with the trajectory of flight of electrode 410 and electrode 440 respectively improves the likelihood that the electrode will fly along the trajectory. Coupling filament 414 to a position that is closer to the center axis of bore 402 decreases the force applied by filament 414 that pulls electrode 410 away from the central axis of bore 402 thereby increasing accuracy of flight of electrode 410.

When electrode 410 reaches the target, spear 430 mechanically couples to (e.g., enmeshes in, entangles in, attaches to) the target's clothing (e.g., garments, apparel, outerwear) or pierces and embeds into target tissue to mechanically couple to the target. Signal generator 132 may electrically couple to the target through electrode 410 via interface 170 and deployed filament 414.

In a similar way, spear 450 may mechanically couple electrode 440 to target clothing or embed into target tissue. Signal generator 132 may electrically couple to the target through electrode 440 via interface 170 and deployed filament 444.

Signal generator 132 may provide a stimulus signal through target tissue via interface 170, filament 414, electrode 410, target tissue, electrode 440, filament 444, and interface 170. A high voltage stimulus signal ionizes air in any gaps to electrically coupled signal generator 132 to the target. Signal generator 132 may provide a stimulus signal through the electrical circuit established with the target to impede locomotion of the target.

Figure 5:
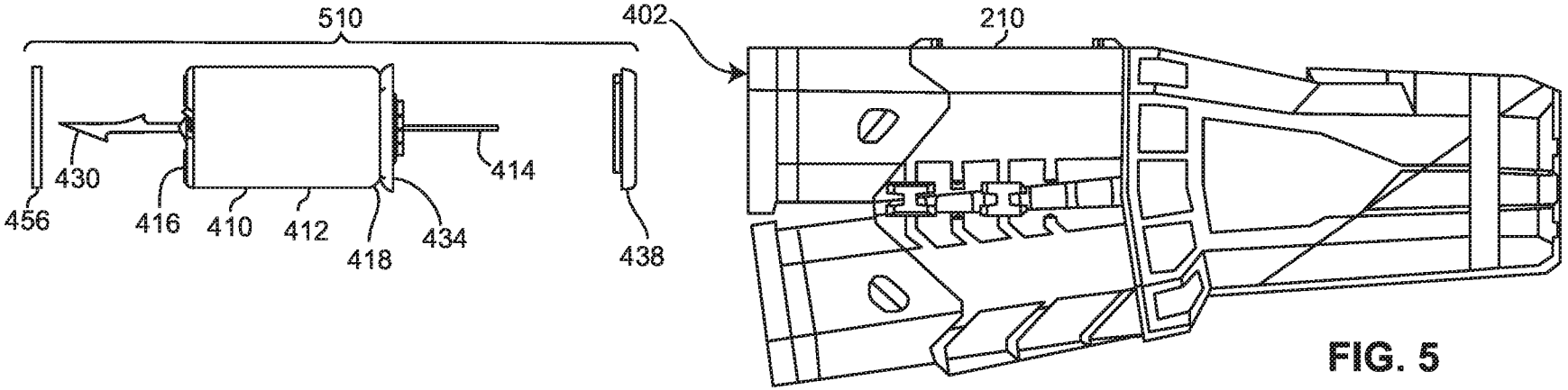
FIG. 5 is an exploded view of the top bore of the deployment unit of FIG. 3.

In an implementation of deployment unit 210, bore 402 includes components 510 in FIG. 5. Bore 402 may include similar components. Components 510 include pad 436, electrode 410, filament 414, and guide 438. Electrode 410 includes spear 430, front wall 416, body 412, rear wall 418, wad 434, and tensioner 432 (refer to FIGS. 6 and 7). Spear 430 is mechanically coupled to front wall 416. Front wall 416 is mechanically coupled to body 412. Rear wall 418 is mechanically coupled to body 412. Components 510 are positioned in bore 402 prior to launch.

In an implementation, pad 436 and pad 456 are a 0.04 inch thick slice of a thermoplastic elastomer respectively. Pad 436 and pad 456 are mechanically coupled to front wall 416 and 446 respectively. Pad 436 and pad 456 may absorb some of the force of impact with a target thereby reducing potential tissue or skin damage (e.g., bruising, tearing) to the target. Pad 436 and pad 456 may reduce the momentum of electrode 410 and electrode 440 after impact, thereby hindering (e.g., preventing) electrode 410 and 440 from bouncing off of the target with enough residual force to decouple spear 430 and spear 450 respectively from the clothing or tissue of the target.

In an implementation, wad 434 is mechanically coupled to a rear-end portion of electrode 410. Wad 434 may be made of a low-density polyethylene (e.g., a soft plastic). A soft plastic composition allows wad 434 to expand to seal bore 402 behind electrode 410 when a rapidly expanding gas enters from the rear-end portion of bore 402. During launch, wad 434 seals bore 402 to decrease an amount of the rapidly expanding gas that bypasses electrode 410 thereby increasing the force transferred from the rapidly expanding gas to electrode 410, thereby increasing muzzle velocity of electrode 410. Increased muzzle velocity may result in increased flight distance and/or improved accuracy of electrode 410. Further, reducing gas leaks around the electrodes reduces a variation (e.g., in muzzle velocity) between deployment units, thereby improving repeatability of flight distance and/or accuracy between deployment units.

In an implementation, tensioner 432 is mechanically coupled to rear wall 418 and/or wad 434. Tensioner 432 may be made of a urethane foam. Tensioner 432 has a hole therethrough.

In an implementation, filament 414 is an insulated wire having an outer diameter of about 15/1000 inches. The conductor of filament 414 may be a copper-clad steel that is insulated with a Teflon insulator. The insulator on filament 414 may include a clear coat proximate to the conductor that is covered with a coat having a green color to provide greater visibility to the filament when used in the field.

In an implementation, the diameter of a hole in tensioner 432 is 20/1000 inches. Filament 414 deploys through the hole in tensioner 432. The hole in tensioner 432 is axially centered with opening 710 in rear wall 418. As filament 414 deploys from electrode 410, filament 414 moves through the hole in tensioner 432. Friction between an inner wall of the hole of tensioner 432 and filament 414 applies a force on filament 414. A force on filament 414 provided by tensioner 432 during deployment provides drag on electrode 410. The drag provided by tensioner 432 increases the stability of flight for electrode 410. The drag provided by tensioner 432 increases accuracy of flight along an intended trajectory. Increasing stability and/or accuracy improves the repeatability of flight along an intended trajectory of electrodes launched from different deployment units.

Figure 8:
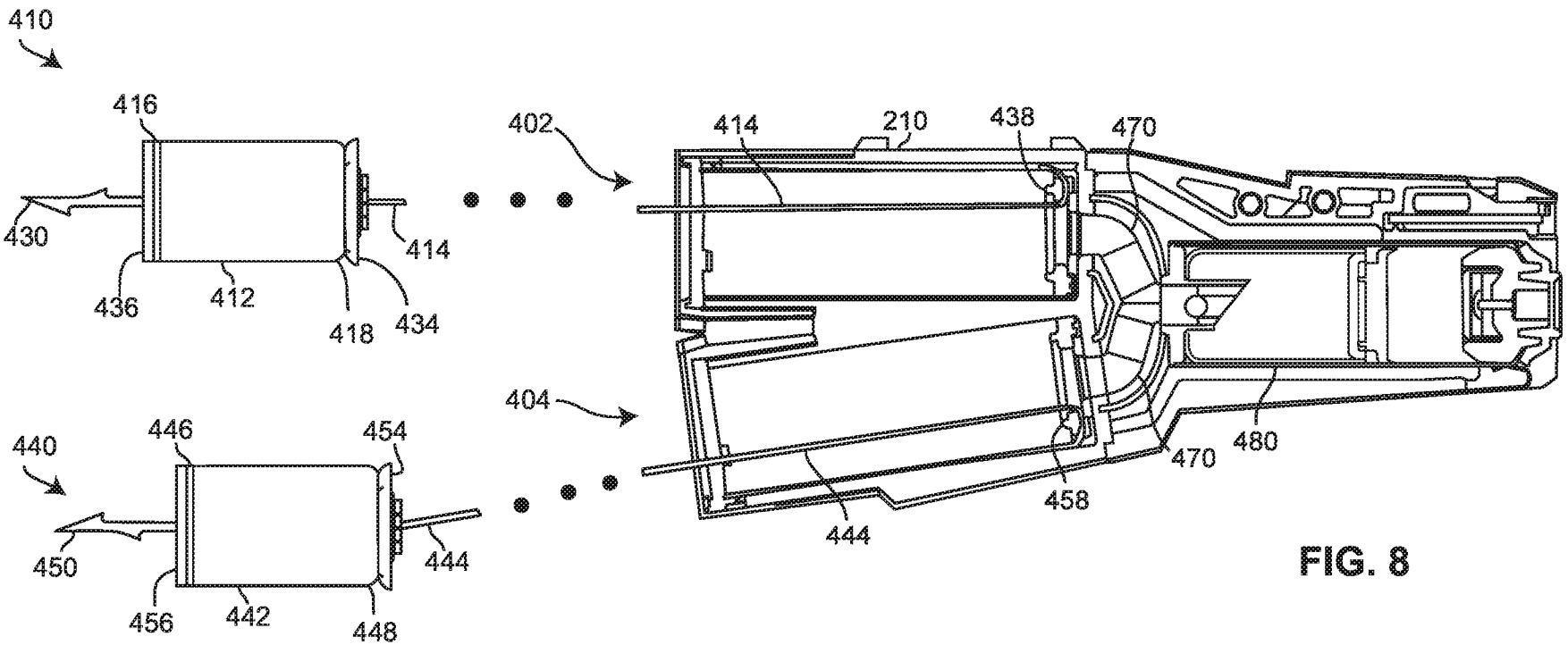
FIG. 8 is the cross-section of FIG. 4 after launch of the electrodes.
Figure 6:
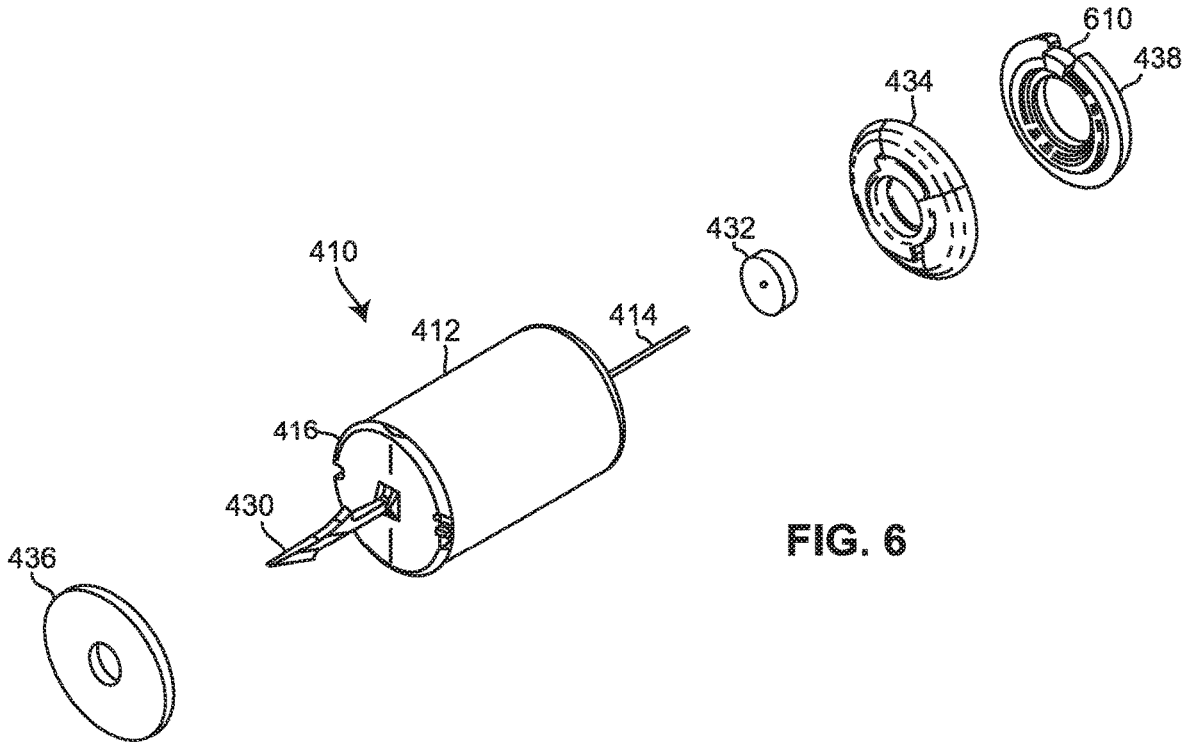
FIG. 6 is a perspective view of the components from FIG. 5.
Figure 7:
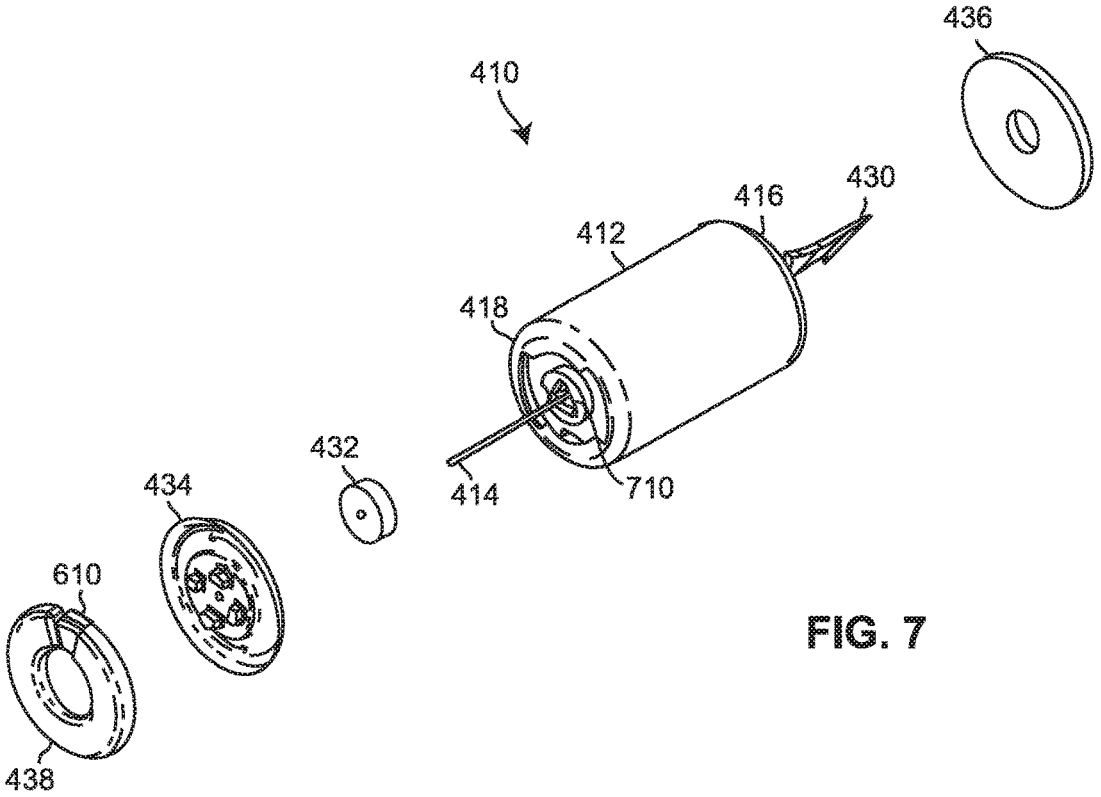
FIG. 7 is a perspective view of the components from FIG. 5.
Figure 9:
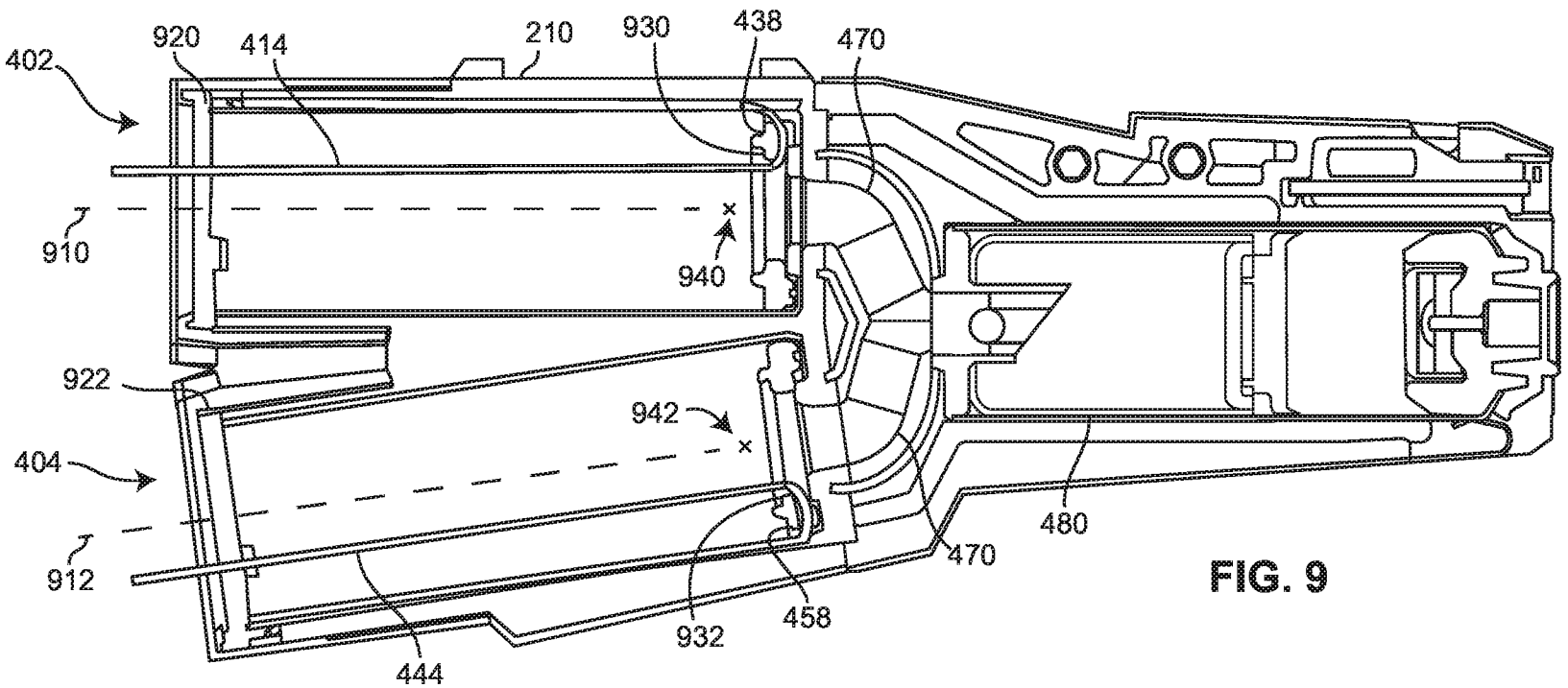
FIG. 9 is a close-up of FIG. 8 showing the positioning of the filaments in each bore.

In an implementation, guides 438 and 458 are positioned at the rear-end portion of bores 402 and 404, respectively, as shown in FIGS. 6 and 8-9. Guide 438 and 458 position filaments 414 and 444 closer to the launch (e.g., initial) trajectories of electrode 410 and 440 respectively. Guide 438 and 458 have a hole therethrough that allows the rapidly expanding gas from propulsions system 480 into bore 402 and 404 via manifold 470.

Filament 414 is deployed from electrode 410 during flight. Filament 414 remains coupled to the deployment unit 210 before, during and after launch of the electrode. Guide 438 positions filament 414 closer to the launch trajectory of electrode 410.

For example, referring to FIG. 9, axis 910 is the center axis of bore 402 and axis 912 is the center axis of bore 404. Upon launch, electrode 410 exits bore 402 along axis 910. For a first portion of flight, electrode 410 continues to travel along axis 910. The location at which filament 414 couples to deployment unit 210 may be referred to as a coupling point. For example, coupling points 920 and 922 are positioned at a front of deployment unit 210. Coupling point 930 is position at a rear of bore 402 above axis 910. Coupling point 932 is position at a rear of bore 404 below axis 912. Coupling points 940 and 942 are position at a rear of bore 402 in-line with axis 910 and at a rear of bore 404 in-line with axis 912.

Coupling filament 414 or 444 at coupling points 920, 922, 930, or 932 positions filament 414 and filament 444 a distance, measured orthogonally, away from axis 910. The distance between axis 910 and coupling points 920 is greater than the distance between axis 910 and coupling point 930 and likewise with coupling points 922, 932, and 942, and axis 912. Coupling filament 414 at coupling point 940 or filament 444 at coupling point 942 would position filament 414 and filament 444 respectively directly in line with axis 910 and axis 912 respectively so that there is no distance between filament 414 and axis 910 or filament 444 and axis 912. However, coupling points 940 and 942 are by openings (e.g., passages) in the rear-end portion of bore 402 and bore 404 respectively, so there is no structure at coupling points 940 and 942 for coupling filament 414 and filament 444.

The greater the distance between the coupling point and axis 910, the greater the force applied on electrode 410 via filament 414 that pulls electrode 410 away from flying along axis 910 after launch. Pulling electrode 410 away from flight along axis 910, at least initially, decreases the accuracy of repeatable delivery of electrode 410 to a location on the target.

Guide 438 holds filament 414 mechanically coupled at point 930 thereby improving accuracy of flight of electrode 410. Guide 438 positions filament closer to axis 910 than if filament 414 were coupled at coupling points 920. Guide 458 holds filament 444 mechanically coupled at point 932 thereby improving accuracy of flight of electrode 440. Guide 458 positions filament closer to axis 912 than if filament 444 were coupled at coupling points 922.

Further, although the passages through the center of guides 438 and 458 preclude coupling filament 414 at coupling point 940 and filament 44 at coupling point 942, the passages permits the flow of the rapidly expanding gas into bores 402 and 404 without interference. Notch 610 allows a space for filament 414 to be positioned between guide 438 and an inner wall of bore 402. A similar notch in guide 458 (not shown) positions filament 444 between guide 458 and an inner wall of bore 404.

In an implementation, deployment pair 1000 includes deployment units 210 and 220. Deployment unit 210 includes posts 250, 350, 1030, and 1050 and deployment unit 220 includes posts 1020, 1040, 1060, and 1080 as discussed above.

Posts 250 and 350 extend from a side of deployment unit 210 and cooperate with slot 240 in handle 230 to improve the mechanical coupling between deployment unit 210 and handle 230. Post 1060 and 1080 extend from a side of deployment unit 220 and cooperate with slot 1240 in handle 230 to improve the mechanical coupling between deployment unit 220 and handle 230. The sides of a slot interfere with the posts inserted into the slot to reduce movement of the deployment units responsive to a recoil force produced on launch of electrodes from the deployment units.

In an implementation with two deployment units (e.g., 210 and 220), posts may be positioned adjacent to each other so that the posts from deployment unit link with (e.g., interlock with, couple to, interfere with) the posts of the other deployment unit. The interlocking of posts of adjacent deployment units increases the stability of the deployment units during use of the CEW. In particular, interlocking posts reduce movement of the deployment units in response to the force of recoil produced on launch of the electrodes from either of the deployment units.

Figure 10:
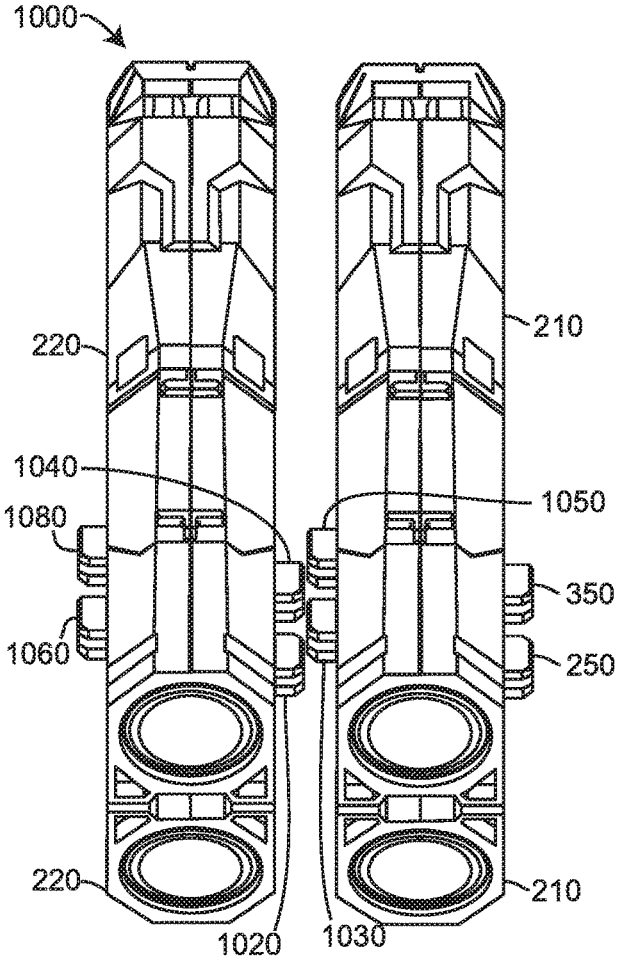
FIG. 10 is a perspective view of the deployment units of FIG. 2 removed from the CEW.
Figure 11:
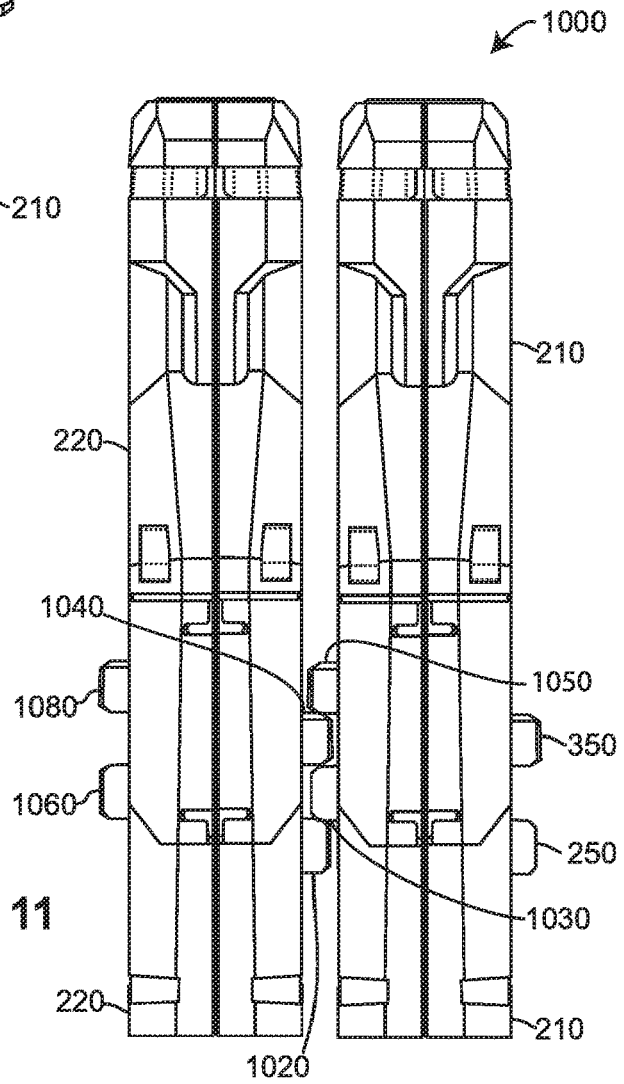
FIG. 11 is a top view of the deployment units of FIG. 10 with interlocked posts.
Figure 12:
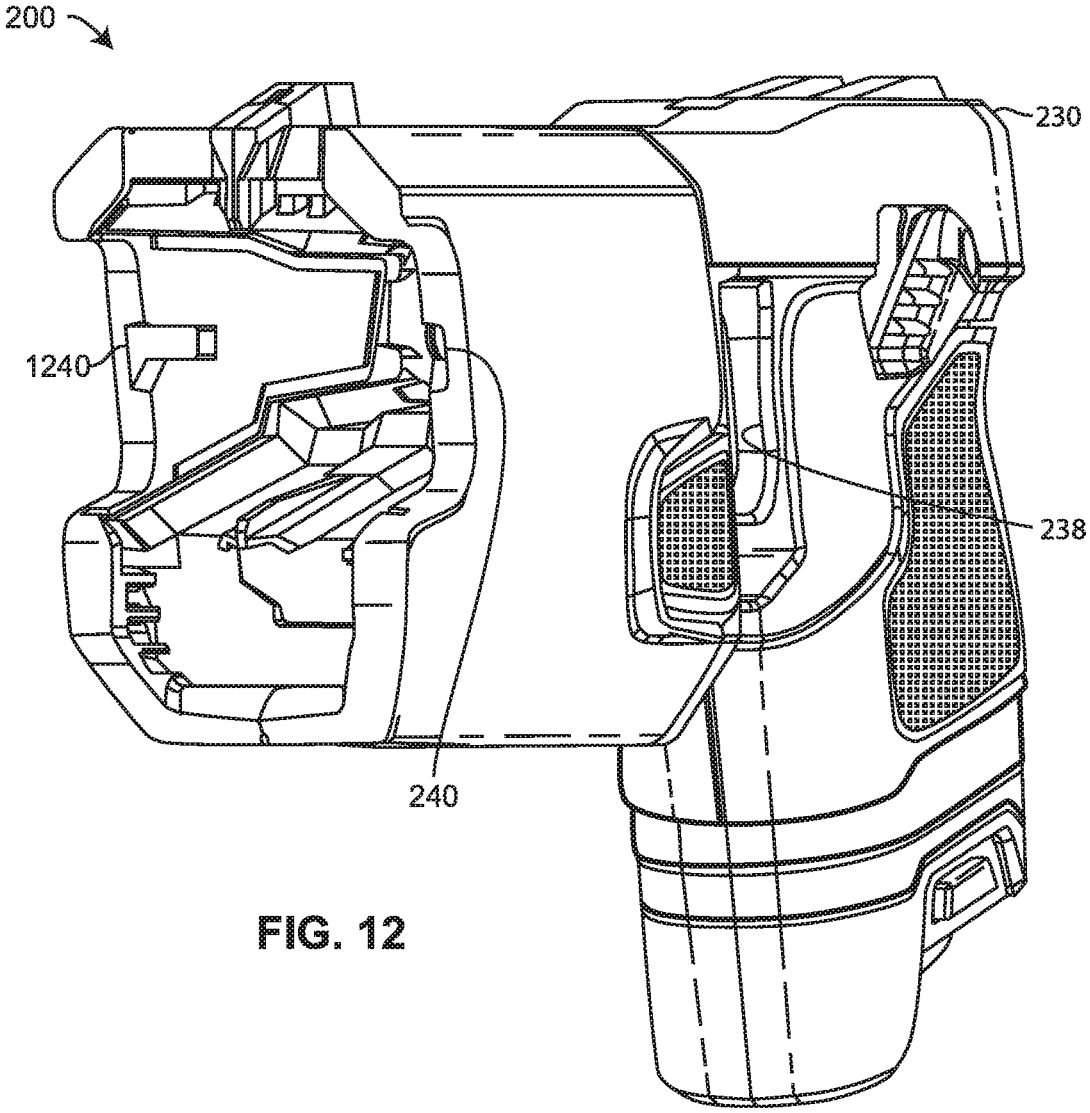
FIG. 12 is a perspective view of the CEW of FIG. 2 with the deployment units removed from the CEW.

For example, referring to FIGS. 10 and 11, posts 1030 and 1050 of deployment unit 210 are positioned to link to posts 1020 and 1040 of deployment unit 220. Post 1030 is positioned between 1020 and 1040. Post 1040 is positioned between posts 1030 and 1050. While the posts are so positioned, pressing deployment unit 210 toward deployment unit 220 causes posts 1020, 1030, 1040, and 1050 to mechanically couple to (e.g., mechanical interfere with, interlock with) each other. Deployment units 210 and 220 so linked may be referred to as deployment pair 1000. Deployment pair 1000 may be inserted into and remove from a handle 230 while linked together. Loading and unloading deployment units that are interlocked as deployment pair 1000 may decrease the amount of time required to replace the deployment units in a CEW. Linking deployment units 210 and 220 may improve accuracy of launch of the electrodes from deployment units 210 and 220 because the deployment units are more stable (e.g., move less) during launch of the electrodes.

Further embodiments of the disclosure include the following.

A deployment pair comprising: a first deployment unit; a second deployment unit; wherein: each deployment unit respectively includes: a first post and a second post positioned on a first side of the deployment unit; and a third post and a fourth post are positioned on a second side of the deployment unit; and the second side of the first deployment unit is positioned proximate to the first side of the second deployment unit; and the third post and fourth post of on the second side of the first deployment unit interlock with the first post and second post on the first side of the second deployment unit.

The deployment pair discussed above wherein the third post and fourth post interlocking with the first post and second post decreases movement of the first deployment unit with respect to the second deployment unit.

The deployment pair discussed above wherein while the deployment pair is inserted into a provided handle: the first post and second post on the first side of the first deployment unit are positioned in a first slot in the handle; the third post and the fourth post on the second side of the second deployment unit are positioned in a second slot in the handle; and the first slot interferes with movement of the first post and second post on the first side of the first deployment; and the second slot interferes with movement of the third post and the fourth post of the second side of the second deployment unit.

A deployment unit for cooperating with a provided handle of a conducted electrical weapon ("CEW") to launch one or more electrodes toward a target to provide a current through the target to impede locomotion of the target, the deployment unit comprising: one or more bores; one or more electrodes, one electrode positioned in each bore respectively prior to launch; a propulsion system, the propulsion system for launching the one or more electrodes from the one or more bores; and one or more posts; wherein: the one or more posts extend from a side of the deployment unit; the one or more posts enter a slot in a handle of a CEW; and the one or more posts cooperate with the slot to impede movement of the deployment unit in the handle responsive to a force of recoil thereby improving accuracy of launch of the one or more electrodes from the one or more bores.

The deployment unit discussed above wherein: a number of posts is four; a first post and a second post are positioned on a first side of the deployment unit; and a third post and a fourth post are positioned on a second side of the deployment unit.

The deployment unit discussed above wherein: the first post and the second post are positioned to interlock with a third post and a fourth post of another deployment unit.

The deployment unit discussed above wherein each post of the one or more posts have an I-beam shape.

The foregoing description discusses embodiments, which may be changed or modified without departing from the scope of the present disclosure as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments have been described, the scope of the invention is intended to be measured by the claims as set forth below. In the claims, the term "provided" is used to definitively identify an object that not a claimed element but an object that performs the function of a workpiece. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

The location indicators "herein", "hereunder", "above", "below", or other word that refer to a location, whether specific or general, in the specification shall be construed to refer to any location in the specification whether the location is before or after the location indicator.

What is claimed is:

1. An electrode for a conducted electrical weapon ("CEW") comprising:

a body having a front end and a rear end; and a wad coupled to the rear end of the body, wherein the wad is configured to increase a muzzle velocity of the electrode, and wherein the wad is configured to remain coupled to the rear end of the body before, during, and after a deployment of the electrode from the CEW.

2. The electrode of claim 1, wherein the wad is configured to expand during the deployment to increase an amount of force delivered to the body during the deployment.

3. The electrode of claim 1, wherein the body comprises a first diameter, wherein the wad comprises a second diameter, and wherein the second diameter is greater than the first diameter.

4. The electrode of claim 1, wherein the wad defines an opening, and wherein the opening is in fluid communication with an interior of the body.

5. The electrode of claim 4, further comprising a rear wall defining the rear end of the body, wherein the rear wall defines a second opening, and wherein the second opening of the rear wall is axially aligned with the opening of the wad.

6. The electrode of claim 1, further comprising a tensioner positioned between the rear end of the body and the wad.

7. The electrode of claim 6, wherein the tensioner is coupled to at least one of the rear end of the body or the wad.

8. The electrode of claim 6, wherein the tensioner comprises a first diameter, wherein the wad comprises a second diameter, and wherein the second diameter is greater than the first diameter.

9. The electrode of claim 6, wherein the tensioner defines a hole, wherein the wad defines an opening, and wherein the hole of the tensioner is axially aligned with the opening of the wad.

10. The electrode of claim 9, wherein the hole of the tensioner and the opening of the wad are in fluid communication with an interior of the body.

11. A deployment unit for a conducted electrical weapon ("CEW") comprising:

a housing defining a bore; and an electrode positioned in the bore, wherein the electrode comprises:

a body having a front end and a rear end; and a wad positioned at the rear end of the body, wherein the wad is configured to increase a muzzle velocity of the electrode, and wherein the wad remains positioned at the rear end of the body before, during, and after a deployment of the electrode from the bore.

12. The deployment unit of claim 11, wherein responsive to the deployment the wad is configured to expand radially outward to contact an inner surface of the bore.

13. The deployment unit of claim 11, further comprising a filament positioned within the body, wherein the filament is configured to be deployed from the rear end of the body through the wad.

14. The deployment unit of claim 13, further comprising a tensioner positioned at the rear end of the body, wherein the tensioner is configured to apply a force on the filament in response to the filament being deployed from the rear end of the body.

15. The deployment unit of claim 14, wherein the tensioner is positioned between the wad and the rear end of the body.

16. An electrode for a conducted electrical weapon ("CEW") comprising:

a body having a front end and a rear end;

a filament deployed from the rear end of the body;

a wad positioned at the rear end of the body, wherein the wad is configured to increase a muzzle velocity of the electrode, and wherein the wad is configured to remain positioned at the rear end of the body before, during, and after a deployment of the electrode from the CEW; and a tensioner positioned at the rear end of the body, wherein the tensioner is configured to apply a force on the filament.

17. The electrode of claim 16, wherein the tensioner is coupled to at least one of the rear end of the body or the wad.

18. The electrode of claim 16, wherein the wad is coupled to the rear end of the body, and wherein the tensioner is positioned between the rear end of the body and the wad.

19. The electrode of claim 16, wherein the tensioner defines a hole, wherein the wad defines an opening, and wherein the hole of the tensioner is axially aligned with the opening of the wad.

20. The electrode of claim 19, wherein the hole of the tensioner and the opening of the wad are in fluid communication with an interior of the body.

* * * * *